United States Patent [19]

Gauthier

[11] 4,157,536

[45] Jun. 5, 1979

[54] SYNCHRONOUS TRANSMISSION DEVICE OF THE VERNIER RESOLVER TYPE INCORPORATING COMPENSATION OF PARASITIC COUPLING

[75] Inventor: Gerard Gauthier, Paris, France

[73] Assignee: Thomson-CSF, Paris, France

[21] Appl. No.: 779,082

[22] Filed: Mar. 18, 1977

[30] Foreign Application Priority Data

May 23, 1976 [FR] France ..... 76 08390

[51] Int. Cl.[2] ..... G08C 19/48

[52] U.S. Cl. ..... 340/198; 318/629; 318/632; 340/186; 340/196

[58] Field of Search ..... 340/186, 187, 195, 196, 340/198; 318/615, 628, 629, 690, 632; 324/200, 225

[56] References Cited

U.S. PATENT DOCUMENTS

| | | | |
|---|---|---|---|
| 2,776,397 | 1/1957 | McWilliams | 318/632 |
| 2,825,018 | 2/1958 | Diamond | 318/629 |
| 3,011,119 | 11/1961 | Starks-Field et al. | 340/198 |
| 3,571,687 | 3/1971 | Larwin | 318/632 |

*Primary Examiner*—John W. Caldwell, Sr.
*Assistant Examiner*—James J. Groody
*Attorney, Agent, or Firm*—Cushman, Darby & Cushman

[57] ABSTRACT

A synchronous transmission device of the vernier resolver type, in which a variable reluctance is produced by the rotation of an unwound magnetic rotor, wherein unwanted inductive and capacitive coupling effects between windings, resulting in parasitic signals appearing in the secondaries, are suppressed by application of compensating signals picked-off through the coupling of each secondary with a compensating winding, the supply to which is picked-off from the excitation signals applied to the primary, and adjusted by a divider bridge.

8 Claims, 8 Drawing Figures

SYNCHRONOUS TRANSMISSION DEVICE OF THE VERNIER RESOLVER TYPE INCORPORATING COMPENSATION OF PARASITIC COUPLING

The present invention relates to the field of devices for the electrical transmission of geometric data such as lengths or angles, that is to say devices of the kind known by the name of variable reluctance transformers. The geometric piece of information to be transmitted acts in said device to vary the reluctance of the air-gap in the magnetic circuit of the transformer, the latter being supplied with constant electrical power through its primary and the voltage picked off across its secondary constituting an electrical measurement of the piece of information. In the case where devices of the kind are designed to transmit angular quantities they have a structure which is generally that of a cylinder of revolution in which the primary and secondary windings are wound on cores of magnetic material distributed over the lateral surface of a fixed cylinder or stator, the variations in reluctance characteristic of the angles of rotation to be transmitted, being produced by the transfer past these windings of relief portions carried by a rotor and likewise made of magnetic material.

The operation of this kind of device is based upon the fact that when the primary windings or inductors are supplied from a source of alternating electrical energy, the secondary windings or armatures give rise to induced voltages which increase with the values of the magnetic fluxes passing through the stator cores; however, these fluxes depend upon the reluctance between the cores and the rotor and therefore, ultimately, upon the position of the relief parts or teeth of the rotor in relation to the stator cores.

In practical embodiments, there is no direct correlation between the angular distribution of the cores and that of the magnetic poles created either by the inductor windings or by the armature windings, and it is possible by an appropriate choice of the number of turns in the coils located on each core, to obtain any desired distribution of magnetic poles.

One particularly simple known embodiment of rotary devices of this kind, which are known as resolvers, is that in which the stator comprises two inductor windings corresponding to poles which are out of phase by 90°, and two armature windings corresponding to poles which are likewise 90° out of phase.

In this case, as will be explained in more detail later on, the alternating voltages picked off across the terminals of the two sets of secondary or armature windings, are respectively proportional to trigonometric lines defined as the sine and cosine of an angle varying through 360° for an angle of rotation on the part of the rotor, corresponding to the passage of two successive teeth on the latter past a pole on the stator.

This kind of device is then referred to in the art as a vernier resolver and, if the rotor simply carries two diametrally opposite teeth, it is known as a microsyn.

Devices of this kind have been described for example in "The Bell System Technical Journal" No. 6 dated November 1957.

Althrough devices of this kind may find the same applications as conventional synchronous transmission devices, their characteristic advantage in possessing no rotor windings and consequently freedom from the drawbacks associated with the well-known need to connect the wound rotors through brush and ring systems, lends them high resistance to vibrations and to severe environmental conditions so that they are particularly well suited to use in on-board electrical equipment for the transmission of in other words telemetry, of angular data, in aviation.

However, despite these advantages these devices have not undergone the industrial development which they could merit because their accuracy is limited by parasitic phenomena inherent in all systems of the transformer kind.

It is particularly well known in the context of transformers that amongst the undesirable phenomena which interfere with optimum operation, there figure strongly the effect of parasitic coupling between the primary and secondary windings, these coupling effects being either magnetic and operating through induction or electrostatic and operating through capacitive mechanisms.

The devices of the vernier resolver kind which, as indicated earlier, belong to the transformer family, also exhibit these coupling phenomena, which in this application give rise to a particularly serious drawback, namely a degradation in the accuracy obtained in the transmission of angular quantities. The object of the present invention is to provide improved devices of the vernier resolver kind, which compensate for the influence of these parasitic phenomena.

The need for this kind of improvement is the more marked in certain situations where trigonometric signals emitted initially by the synchro-resolver device (which through the following text will be referred to as an emitter, for reasons of clarity) are processed, after transmission, by a second device of identical structure to the first. This synchro-resolver, which will hereinafter be referred to as a receiver, by rotation of its rotor copies the transmitted angular value $\theta$, for example under the control of an electric motor slaved to the differences between said received angular value and the real position $\theta'$ of its rotor, so that the motor stops when the condition $\theta=\theta'$ is achieved.

This receiver device then likewise exhibits certain drawbacks of the kind referred to earlier in respect of the emitter device the solution employed in the case of the present invention is based upon the fact that the unwanted parasitic voltages, whether of capacitive or inductive origin, have a representative vector one component of which is in-phase with the axis of the vector corresponding to the maximum useful induced voltage, and whose amplitudes are proportional to the supply voltage, advantageous use therefore being made of a fraction of this voltage in order to apply it, in antiphase, to the windings which are the source of the unwanted parasitic voltages requiring compensation.

More precisely, the invention relates to a synchronous transmission device of the vernier resolver kind, incorporating compenstion of parasitic coupling, which on the one hand comprises a stator constituted by a magnetic circuit equipped with relief elements, plus two groups of primary and secondary windings defining pairs of poles arranged at 90° from one another, and on the other hand comprises a rotor carrying teeth which, in passing in front of said elements, cause the reluctance of said circuit to vary, said device being primarily characterized that it comprises means for compensating for the parasitic coupling between certain at least of said windings, these means firstly comprising arrangements for picking off compensating voltages from one of the two windings which give rise to the parasitic coupling, secondary arrangements for introducing said voltages into the other of the two windings responsible for producing the parasitic coupling and thirdly arrangements for adjusting said compensating voltages in terms of magnitude and sign.

The invention will be better understood from a consideration of the ensuing description and by reference to the attached figures in which.

Figure 1:
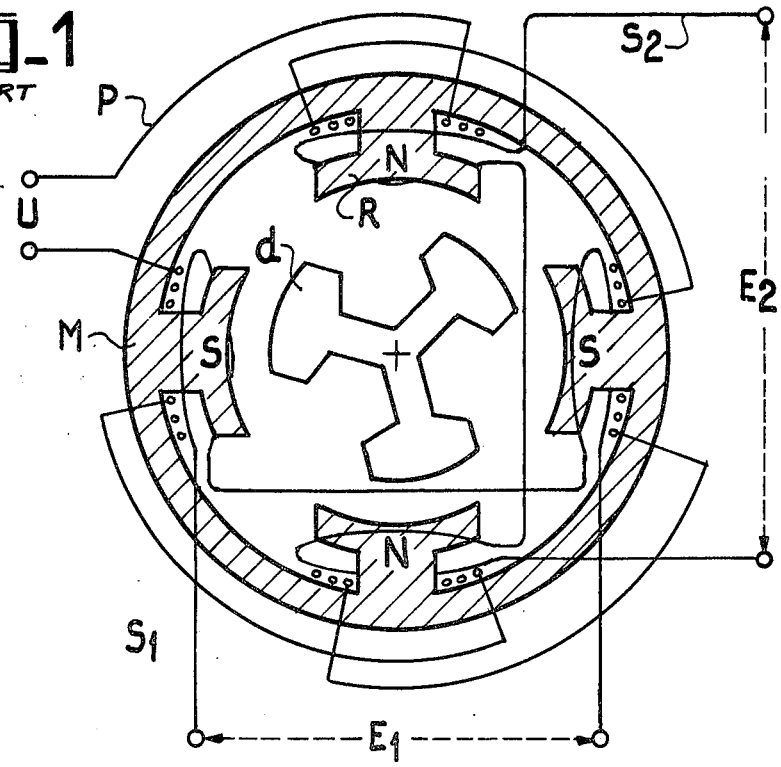
FIG. 1 PRIOR ART
FIG. 1 illustrates a schematic view of a vernier resolver of known kind, connected as an emitter.

FIG. 1 illustrates a schematic view of a known kind of vernier resolver. It has the structure of a variable-reluctance differential transformer constituted by a magnetic circuit M and two sets of windings, a primary winding P and two secondaries $S_1$ and $S_2$ connected in an arrangement which will be referred to as a stator. The variation in the reluctance of the magnetic circuit is produces by a rotary component, or rotor, constituted by a magnetizable material and equipped with relief portions of teeth such as those marked d.

The primary winding P takes the form of coils wound on relief portions of the stator, such as those marked R, and connected in series in such a fashion that two adjacent relief portions carry oppositely wound coils; the secondary windings, $S_1$ and $S_2$, carried by the same relief portions, are each in the form of two coils connected in series pairs, using a method of connection such that two opposite relief portions on the stator carry oppositely wound coils. In operation, the primary is supplied with an alternating voltage whose frequency and amplitude U are constant, and the secondaries $S_1$ and $S_2$ furnish across their respective terminals, induced voltage $E_1$ and $E_2$ which depend upon the reluctance of the magnetic circuit. It is the passage of the teeth d of the rotor past the fixed relief portions on the stator, which brings about this variation in reluctance. Every time one of the teeth on the rotor moves into the place of its predecessor, the variable reluctance and, consequently the magnetic state of the stator, passes through a complete period of variation; if we call n the number of teeth on the rotor, there will thus be n periods of variation in this magnetic state, per revolution. The induced alternating voltages $E_1$ and $E_2$ which are dependent upon this, therefore have the same periodicity; and, because of the arrangement of the armature windings $S_1$ and $S_2$ on the stator, at 90° to one another, these being the windings in which the voltages are developed, their amplitudes are respectively proportional to the trigonometric functions, sine and cosine, of the angles corresponding to each complete period of variation in the reluctance, in other words for an angle of rotation $\theta$ on the part of the rotor the voltages are proportional to the trigonometric functions sine $n\theta$ and cos $n\theta$.

The result is that in the case of the vernier resolver shown by way of example, in which the rotor has three teeth, the voltages $E_1$ and $E_2$ induced in the secondaries $S_1$ and $S_2$ by the alternating voltage $v$ at the input of the primary, take the form:

$$E_1 = kv_o \sin(\omega t + \phi) \sin 3\theta$$

$$E_2 = kv_o \sin(\omega t + \phi) \cos 3\theta$$

where $v = U_o \sin \omega t$;

$\omega = 2\pi F$, where F is the frequency of the voltage applied to the primary;

$\theta$ = the angle of rotation of the rotor;

k = the transformation ratio between primary and secondary;

$\phi$ = the phase-shift angle between primary and secondary;

In a general way, taking the case in which the rotor has n teeth, the relationships for $E_1$ and $E_2$ will have the values sine $n\theta$ and cos $n\theta$.

It is these voltage values $E_1$ and $E_2$ which constitute the electrical representation of the angular value $\theta$ and which can be utilized by any known receiver means encountered in the field of transmission or in other words telemetry technology, with a precision per revolution of the rotor, which is the higher the larger the number n of teeth which the rotor carries. It is precisely devices of the vernier resolver kind which lend themselves to the production, in association with "coarse" transmission and when driven directly by the same rotating shaft, of a complementary fine piece of information of the "vernier" kind without the need, which is encountered in conventional resolver devices, for step-up gear trains which are heavy bulky and subject to the effects of friction.

Figure 2:
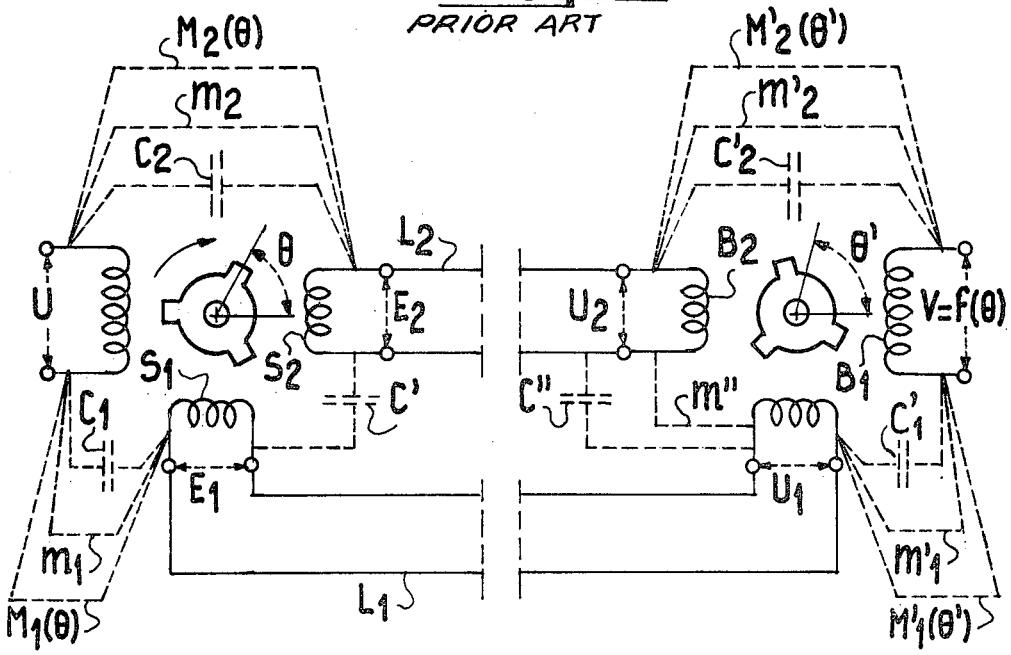
FIG. 2 PRIOR ART
FIG. 2 illustrates a transmission or in other words telemetry system using two vernier resolvers, respectively an emitter and a receiver, together with an illustration of the parasitic coupling phenomena.

FIG. 2 illustrates a diagram of a transmission or telemetry device using two vernier resolvers, of the kind described earlier, and illustrates in a more detailed fashion the parasitic coupling phenomena, already referred to earlier, to which these devices give rise.

The device comprises an emitter I and receiver II connected by two transmission lines $L_1$ and $L_2$ respectively carrying the angular signals proportional to the sine and cosine of the angle $n\theta$. The constant alternating excitation voltage $v$ is applied to the primary of the emitter I and this gives rise to the following phenomena in its windings:

(a) between the primary P and the secondaries $S_1$ and $S_2$:

an effective inductive coupling which is dependent upon the position of the rotor, represented by the coefficients $M_1(\theta)$ and $M_2(\theta)$ of mutual inductance;

a parasitic and constant inductive coupling proportional to the excitation voltage $v$, represented by the coefficients $m_1$ and $m_2$ of mutual inductance;

a constant parasitic capacitive coupling between the same windings, represented by the capacitances $C_1$ and $C_2$.

(b) on the other hand, there is an essentially capacitive coupling C' between the two secondaries $S_1$ and $S_2$.

At the receiver II, the following phenomena are observed in its windings:

(a) between the inductors $B_1$ and $B_2$ and the armature F:

an effective inductive coupling depending upon the position $\theta'$ the rotor, represented by the coefficients of mutual inductance $M'_1(\theta')$ and $M'_2(\theta')$;

a constant parasitic inductive coupling represented by the coefficients of mutual inductance $m'_1$ and $m'_2$;

a constant parasitic capacitive coupling represented by the capacitances $C'_1$ and $C'_2$.

(b) between the two inductors $B_1$ and $B_2$ there are observed:

an inductive coupling, represented by the coefficient of mutual inductance $m''$;

a capacitive coupling, represented by the capacitance $C''$.

Thus, the electrical signals emitted by the emitter I are affected by parasitic signals those of whose components which are in phase with the maximum voltage axis take the form, in the case of the secondary $S_1$, of:

$$\left.\begin{array}{l} \alpha_1 = am_1\nu \text{ in the case of the inductive parts;} \\ \beta_1 = bC_1\nu \text{ in the case of the capacitances relating to the primary P; and} \\ \gamma_1 = cC'E_2 \text{ in the case of the capacitance relating to the secondary } S_2. \end{array}\right\} \text{a,b,c, are constant coefficients}$$

Similarly the signal emitted by the secondary $S_2$ is affected by parasitic voltages $\alpha_2$, $\beta_3$ and $\gamma_2$ of corresponding kind. It is essential, however, to point out that the parasitic voltages of types $\alpha$ and $\beta$ are all proportional to the excitation voltage $\upsilon_o$, and consequently to the current flowing through the inductor; the parasitic voltages of type $\epsilon$ are proportional to the induced voltages E in the opposite secondary. The result is that compensating voltages which can be used appear across the terminals of the device itself and can, therefore, in accordance with the invention, be applied, after matching in terms of magnitude and sign, to the turns of the windings which are in fact the sources of the unwanted parasitic voltages, in order thus to cancel them out.

Similarly, the receiver which is supplied at its inductors $B_1$ and $B_2$ with the respective electrical signals $$\upsilon_1 = k\upsilon_o \sin(\omega t+\phi) \sin n\theta = E_1$$

$$\upsilon_2 = k\upsilon_o \sin(\omega t+\phi) \cos n\theta = E_2$$

will produce across the terminals of its armature a signal $V = kk'\upsilon_o \sin(\omega t+\phi+\phi')\,[M'_1(\theta')\sin(n\theta) - M'_2(\theta')\cos(n\theta)]$ where k' is the transformation ratio between the inductors and the armature, in the receiver, and $\phi'$ is the phase-shift angle between the inductors and the armatures, in the receiver.

This signal is affected by a parasitic voltage in respect of which it will be observed, in the same way as was encountered earlier in the case of the emitter, that it is proportional to the applied voltages and currents.

Here again, in accordance with the invention use is made of the fact that the parasitic signals appearing across the terminals of a winding are proportional to the voltages and currents applied to the terminals of another winding, in order to creat compensating signals from these voltages and currents and apply them, in the appropriate sense, across the terminals of the winding which is responsible for these parasitic signals in order to reduce or cancel their amplitude.

A number of possible embodiments of the vernier resolver type of synchronous transmission device in accordance with the invention, will now be indicated.

Figure 3:
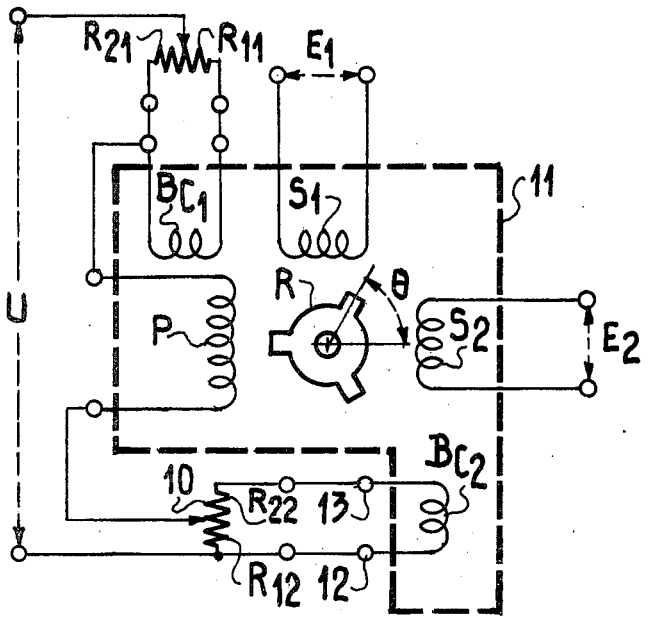
FIGS. 3, 4, 5 and 6 illustrate embodiments of vernier resolvers of the compensated emitter kind in accordance with the invention.

FIG. 3 illustrates a first embodiment relating to an emitter type vernier resolver. In accordance with this embodiment that fraction of the excitation voltage which is required for compensation purposes, is applied across the secondaries $S_1$ and $S_2$ by two supplementary windings $B_{C1}$ and $B_{C2}$ magnetically coupled to these secondaries. Resistive potentiometers such as those marked 10 make it possible, by variation of the resistances $R_{11}$, $R_{21}$, $R_{12}$, $R_{22}$, to adjust each compensating voltage.

The significance of this embodiment is that it lends itself to the incorporation of compensating coils into the resolver itself, the latter having been indicated by the broken line box 11, and to the final determination at the time of manufacture, of the direction of winding of the coils $B_{C1}$ and $B_{C2}$ and of the direction of application of the compensating voltage to their terminals.

By an appropriate choice of the number of turns in the coils it is possible to do away with the need for potentiometers and to connect the coils directly in series with the primaries of the resolver.

Figure 4:
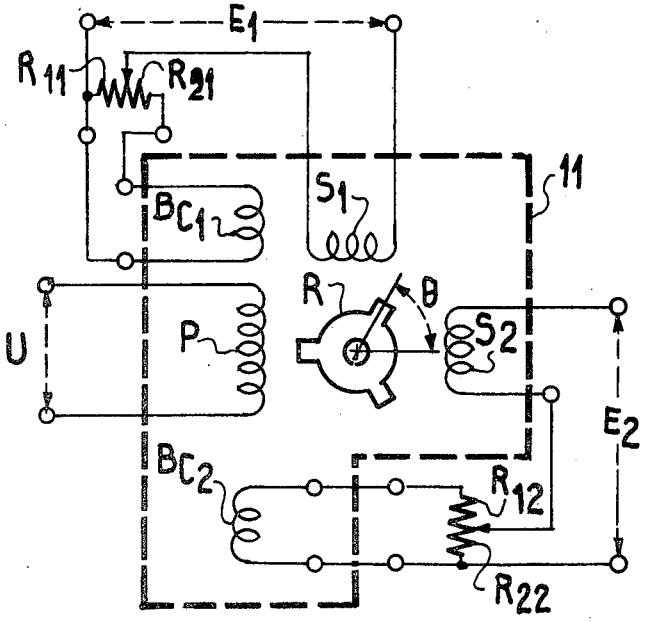

FIG. 4 illustrates a variant of the first embodiment shown in FIG. 3. In accordance with this variant, the additional windings such as $BC_2$, magnetically coupled to the primary P, produce an induced voltage part of which, through the medium of the potentiometer type voltage-divider constituted by the resistors $R_{12}$ and $R_{22}$, is applied in series with the induced voltage to the terminals of the secondary $S_2$ in order to compensate its parasitic voltage component; $E_2$ is the resultant voltage. The voltage $E_1$ is obtained in a similar fashion.

Figure 5:
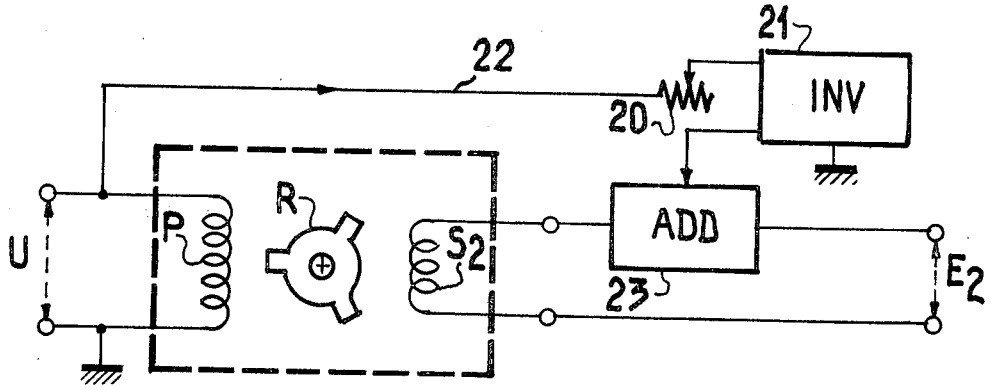

FIG. 5 illustrates a second embodiment likewise applicable to an emitter type resolver, but suitable this time for the modification of an existing, unmodified resolver.

In accordance with this embodiment, that fraction of the excitation voltage $\upsilon$ which is required for compensation is directly applied to the secondary $S_2$ through a connection 22 and an adder element 23.

A variable resistor 20 and a polarity-reversing device 21 make it possible to adjust the amplitude and sign of the compensating voltage.

The adder element 23 can be chosen from among the various devices well known in the art, which perform such a function, as for example transformers and amplifier-mixers.

Figure 6:
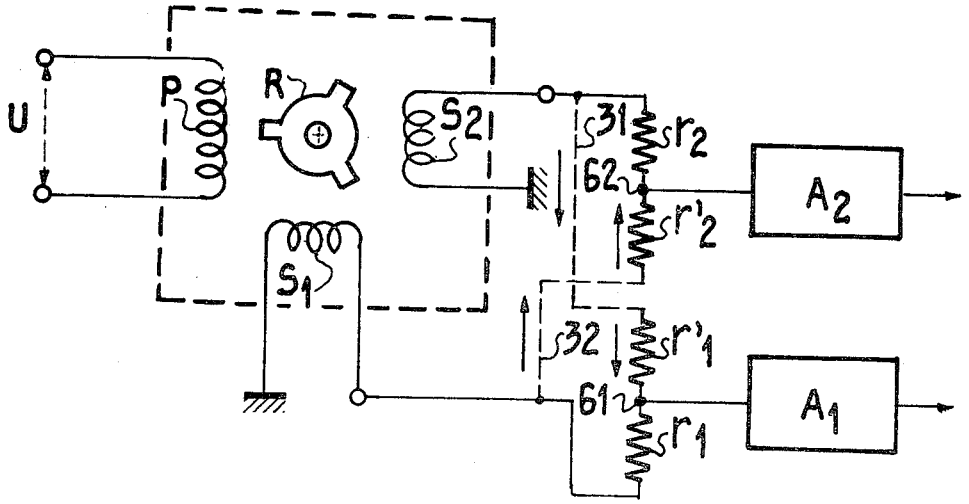

FIG. 6 illustrates an embodiment of a vernier resolver of the emitter type which uses a circuit for compensating for the capacitive coupling occurring between the two secondaries $S_1$ and $S_2$, the nature and characteristics of which coupling have been described earlier on.

This application has recourse to reciprocal pick-off of the effective voltage of one secondary in order, in an adjustable manner, to mix it with the effective voltage of the other secondary.

In the case of the embodiment shown in FIG. 6, a mixer or adder device of the amplifier type has been chosen.

The signals respectively appearing across the terminals of the secondaries $S_1$ and $S_2$ are fed, across the resistors $R_1$ and $R_2$, to the inputs ot two amplifiers $A_1$ and $A_2$.

The compensating signals, which are picked off in the manner indicated earlier, are applied to these same inputs through the lines 31 and 32 across resistors $r'_1$ and $r'_2$ which thus, in effect constitute divider bridges in association with $r_1$ and $r_2$. It should be noted that the symmetrical compensation of crossed type, using two compensating voltages in the manner described and illustrated, can equally well be performed entirely, considering the case of resolvers in which the signals are of the sine and cosine kind, with a single one of the two lines, this by a suitable choice of the resistances of the resistors in the divider bridge, this advantageously simplifying the circuit by the use of a single voltage which is equal to the sum of the two compensating voltages.

Figure 7:
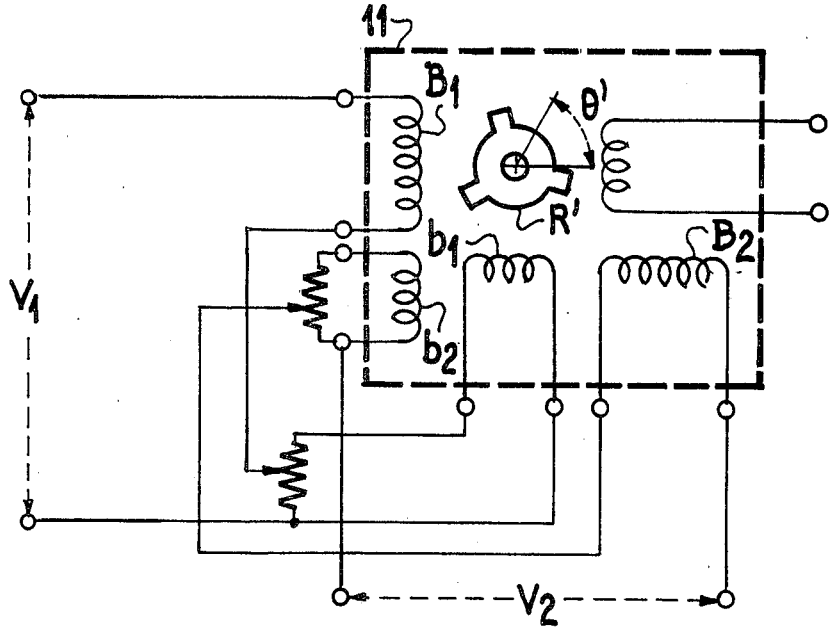
FIG. 7 illustrates a vernier resolver of the receiver kind, with compensating coils.

FIG. 7 illustrates an embodiment of a vernier resolver of the receiver type incorporating compensation of the parasitic coupling occuring between the two inductor windings $B_1$ and $B_2$. The application of the compensating voltages takes place here in a fashion identical to that shown in FIG. 3, these voltages being created in the compensating windings $B_1$ and $B_2$ not this time, from the excitation voltage but from the current supplied to the inductors themselves.

It should be pointed out that because of the symmetrical roles played by the emitter and receiver vernier resolvers, the methods of compensating for the parasitic voltages, which have been employed and described earlier on in the case of emitter vernier resolvers, can also be used in the case of the receiver. In particular, the devices designed in accordance with FIGS. 3 and 4 can be used as emitters or as receivers, equally, the compensation circuits which they incorporate containing passive components only.

Figure 8:
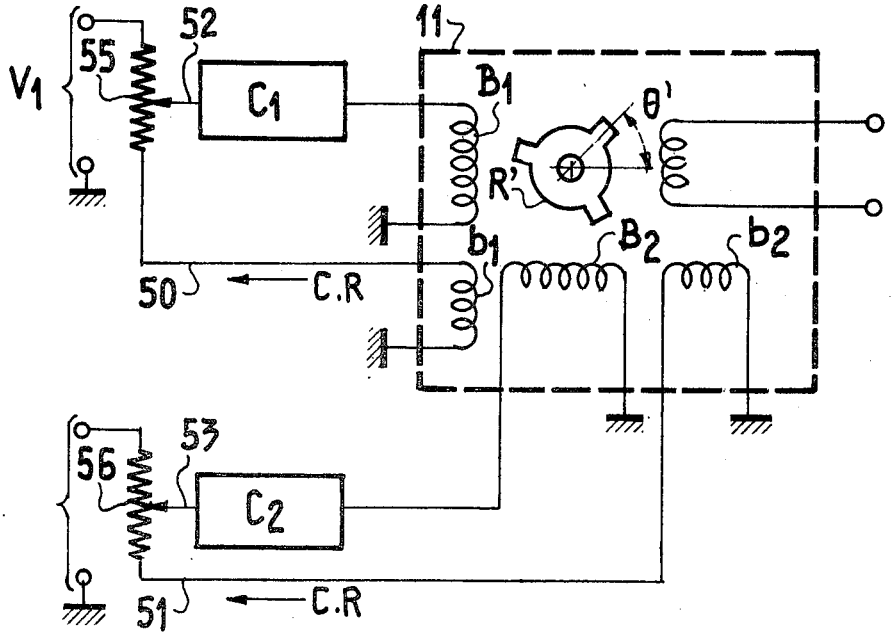
FIG. 8 illustrates a vernier resolver of the emitter kind incorporating compensation by negative feedback.

FIG. 8 illustrates a specially advantageous embodiment of a receiver type vernier resolver, with compensating windings.

In the embodiment shown in FIG. 8, the inductors $B_1$ and $B_2$ are not directly supplied with the angular signals coming from the emitter, receiving them instead through the intermediary of amplifiers such as those $C_1$ and $C_2$.

This arrangement makes it possible to utilise for the supplying of these inductors, the possibilities offered by negative feedback amplification since an electrical compensating signal is available at the terminals of the windings $b_1$ and $b_2$. Depending upon the embodiment, each winding $b_1$ and $b_2$ is connected by negative feedback lines 50 and 51 to the inputs 52 and 53 of the amplifiers $C_1$ and $C_2$; and depending upon the laws controlling the negative feedback circuits, given appropriate adjustement of the divider bridges 55 and 56 the magnetic fields created by the windings $B_1$ and $B_2$ will be substantially proportional to the signals $V_1$ and $V_2$ applied to their terminals.

It should be noted that this embodiment can be used either on its own or simultaneously with that described in FIG. 7.

In accordance with the orders of magnitude given by way of example, receiver type vernier resolvers whose rotor possesses 50 teeth and whose angular accuracy is of the order of $\pm 2$ minutes of arc, have achieved accuracies of $\pm 15$ seconds of arc when equiped with a compensating circuit in accordance with FIG. 4.

Of course the invention is not limited to the embodiment described and shown which was given solely by way of example.

What is claimed is:

1. A synchronous transmission device of the vernier resolver kind incorporating compensation for parasitic couplings, which device comprises a stator made up of a magnetic circuit equipped with internally protruding elements, supporting two groups of windings, an input group and an output group, and comprises a rotor carrying externally protruding elements which in passing before the elements of the stator cause the reluctance of said circuit to vary, wherein are provided means for compensating for parasitic coupling between at least two certain windings of said groups which comprises firstly, means for picking off compensating voltages of one winding of one group, secondly, means for injecting directly said voltages into the other of the two certain windings experiencing the parasitic coupling, and thirdly, means for adjusting said compensating voltages in magnitude.

2. A synchronous transmission device as claimed in claim 1, wherein said pick-off means comprise compensating windings magnetically coupled with at least one of the windings of said output group.

3. A synchronous transmission device as claimed in claim 1, wherein each of said injecting means is constituted by an adder circuit.

4. A synchronous transmission device as claimed in claim 1, wherein said pickup means includes output terminals, said injecting means includes input terminals and said means for adjusting magnitude are arranged in the link between the output terminals of the pick-off means and the input terminals of the injecting means.

5. A synchronous transmission device as claimed in claim 1, wherein said means for adjusting magnitude are constituted by resistive potentiometers.

6. A synchronous transmission device as claimed in claim 1, further including means for adjusting the sign of said compensation voltages comprising a reverse circuit.

7. A synchronous transmission device as claimed in claim 1 wherein said certain windings of said groups are respectively comprised in an input group and an output group.

8. A synchronous transmission device, as claimed in claim 1, wherein said certain windings of said groups are both comprised in an input group.

* * * * *